United States Patent [19]

Brolin

[11] Patent Number: 4,522,244

[45] Date of Patent: Jun. 11, 1985

[54] BEARING BRACKET FOR OUTER-WALL VENETIAN BLINDS

[75] Inventor: Hans Brolin, Mullsjö , Sweden

[73] Assignee: AB Perma System, Mullsjö , Sweden

[21] Appl. No.: 505,328

[22] Filed: Jun. 17, 1983

[30] Foreign Application Priority Data

Jun. 18, 1982 [SE] Sweden ..... 8203812
Feb. 16, 1983 [EP] European Pat. Off. ..... 83-8500 38.7

[51] Int. Cl.[3] ..... E06B 9/30
[52] U.S. Cl. ..... 160/170
[58] Field of Search ..... 160/170, 171, 300; 1/4

[56] References Cited

U.S. PATENT DOCUMENTS 2,732,010 1/1956 Griesser ..... 160/170
4,088,171 5/1978 Schluep et al. ..... 160/170

FOREIGN PATENT DOCUMENTS 409330 10/1966 Switzerland ..... 160/170

*Primary Examiner*—Peter M. Caun
*Assistant Examiner*—David M. Purol
*Attorney, Agent, or Firm*—Witherspoon & Hargest

[57] ABSTRACT

The present invention relates to a bearing bracket for outer-wall Venetian blinds. The bearing bracket comprises a lifting roll (4) and a turning roll (13), these rolls being connected by a coupling (11, 19, 20) which during rotation of the lifting roll (4) in varying directions causes the turning roll (13) to be moved to various predetermined positions of adjustment for the skewing of the blind laths. The predetermined positions of adjustment corresponding to a completely open, completely closed and slightly open Venetian blind. The coupling (11, 19, 20) comprises a ratchet wheel (11) having two rows of ratchet teeth and two pawls (19, 20) for cooperation with one row each of ratchet teeth on the ratchet wheel (11). When rotating the lifting roll (4) the turning roll (13) is carried to the position corresponding to the predetermined positions of adjustment for the skewing of the blind laths. In said positions pawl (19, 20) is brought out of latching engagement with the corresponding set of ratchet teeth on the ratchet wheel (11) and the coupling is disengaged. A sleeve (50) is arranged around the ratchet wheel (11) and the ratchet wheel (11) is rotatable within the sleeve. The sleeve (50) has openings through which the teeth of the pawls (19, 20) can engage the teeth of the ratchet wheel. The sleeve (50) has two abutments of which during the rotation of the ratchet wheel (11) one or the other, depending on the direction of rotation, is brought into contact with the disengaged pawl (19, 20) and lifts it up so that its teeth are free from the teeth of the ratchet wheel (11).

4 Claims, 7 Drawing Figures

FIG. 4A.
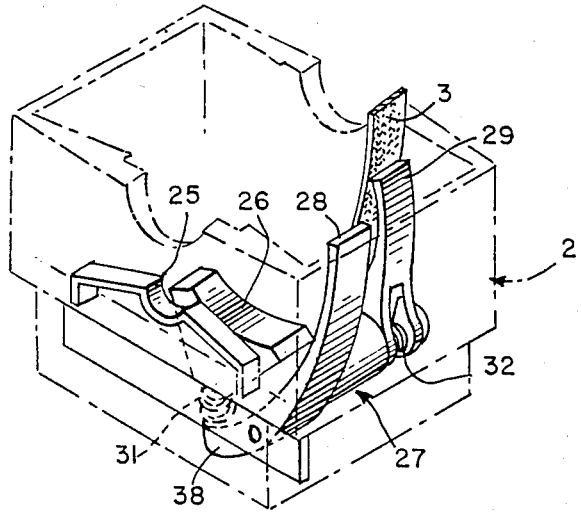
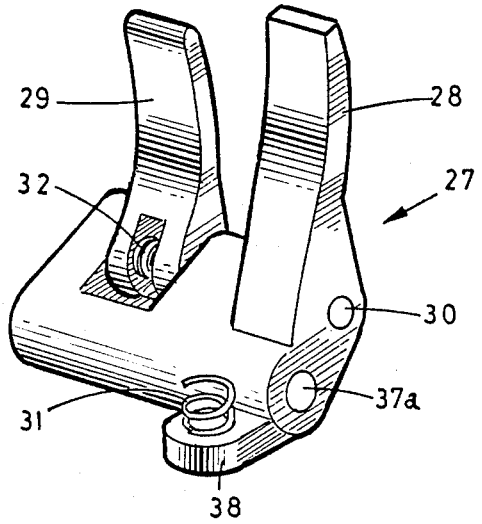
FIG. 4B.

BEARING BRACKET FOR OUTER-WALL VENETIAN BLINDS

BACKGROUND OF THE INVENTION

1. Field of the Invention

The present invention relates to bearing brackets for Venetian blinds and in particular to a bearing bracket for outer wall Venetian blinds for lowering and lifting of the Venetian blind laths and their adjustment to three predetermined positions of adjustment.

2. Description of the Prior Art

Outer-wall Venetian blinds are normally mounted on the outer surface of buildings to be lowered as a sunshade in front of the window of the buildings. Many Venetian blind units are required in order to cover all the windows of a building on one outer wall. For aesthetic reasons it has become desirable to enable the laths of all these Venetian blind units to assume the same positions of adjustment and it has accordingly become normal to predetermine three positions of adjustment or inclination, namely one in which the Venetian blind is fully open, one in which it is fully closed and an intermediate position. Irrespectively of whether the lifting, lowering, and adjustment of the Venetian blinds is performed manually or by some control equipment, e.g. electrically, it is preferred that all the blind units on one and the same outer wall assume the same positions of adjustment.

As examples of prior-art constructions for achieving the above-mentioned aims reference may be made to the contents of Swedish specification No. 74 14482-5 and Swedish published specification No. 76 10441-3. However, these constructions are extremely complicated and bulky whereby their use has been limited and they are sensitive to malfunction due to contaminants. In particular, there is a tendency for dirt and other foreign matter to penetrate the housing and interfer with the operation of the gear mechanism.

In order to keep costs at a minimum and reliability at a maximum, all the parts combined in a Venetian blind should be as simple and few as possible. For this reason it is attempted to use the same source of operation for both lifting, lowering and inclination, and in order to achieve this, attempts have been made to find some sort of coupling between the mechanism responsible for lifting and lowering and the mechanism responsible for the inclination or skewing position of the laths.

As a result, sophisticated bearing brackets have been obtained belonging to the type appearing from the abovementioned publications and comprising both lifting and turning rolls with a coupling inserted between them.

It is a requirement in connection with outer-wall Venetian blinds that the skewing positions of the laths should be maintained even when the blinds are exposed to squall winds, rain, snow and other severe weather conditions. In addition, it is a strong desideratum that during lifting and lowering of the blinds the laths are so skewed that light is permitted to enter and that the bearing brackets do not make any considerable noise during operation of the blinds.

In order to obtain a reliable wind securing the intention has primarily been directed to a use of pawls and ratchet wheel which give a safe locking engagement between the parts as result. However, such a construction shows the disadvantage that when the disconnected pawl is sliding over the teeth on the ratchet wheel there is generated a ratching noise, this noise being stronger and stronger in relation to the increasing force by which the pawls are biased against the ratchet wheel. A strong bias is also generating a heavy wearing.

In order to reduce the noise and the wearing one is trying to keep the bias of the pawls against the ratchet wheel as low as possible and in the known constructions only the dead weight of the pawls is used as the biasing force. However, normally the bearing brackets are mounted outdoors and together with the winds dust and other contaiminants are, accordingly, easily whirling into the brackets and the result thereof is the fact that the pawls jam and do not turn to their locking positions.

As there might be hundreds of bearing brackets on one and the same outer wall it is realized that the noise from the operation of the Venetian blinds can be troublesome as all the Venetian blinds are operated simultaneously and in order to reduce such a noise it is a desideratum to get as quiet bearing brackets as possible. If the bearing brackets then are of the type including pawls the cleaning of hundreds of such brackets for safe function will be an extensive and expensive work.

SUMMARY OF THE INVENTION

The aim of the present invention is to remove the above mentioned problems simultaneously as the safe function is maintained which is obtained by the use of a construction including pawls, the bearing bracket in accordance with the invention giving rise to the said three positions of adjustment of the skewing of the laths, namely one position in which they are adjusted in parallel with the horizontal plane which means that the Venetian blind is open to the maximum degree in the lowered condition, one position in which they are skewed to a vertical plane, which means that the blind is completely closed, and an intermediate position in which the laths are skewed approximately 45° in relation to the horizontal plane. During lifting and lowering of the blind the laths should be skewed to the fully open position or to the intermediate position so that light is admitted. The completely lowered position is the only one in which it is a requirement that a complete closing of the blind should be possible.

Even if the construction according to the present invention in the first place is conceived for outwardly mounted outerwall Venetian blinds, it will be appreciated that it is equally usable for other Venetian blinds irrespective of whether they are mounted indoors or outdoors. It will also be appreciated that other predetermined positions of adjustment in addition to the three positions mentioned are obtainable and that the construction can be modified such as to realize additional positions of adjustment.

The present invention is directed to achieving the above requirements and desiderata. This is obtained by a construction of the type indicated in the claims which also define the particular characteristic features of the invention.

BRIEF DESCRIPTION OF THE DRAWING

The invention is more closely described hereafter by reference to the attached drawings in which FIG. 4 is a perspective view of the intermediate-position giver.

DESCRIPTION OF THE PREFERRED EMBODIMENT

Figure 1:
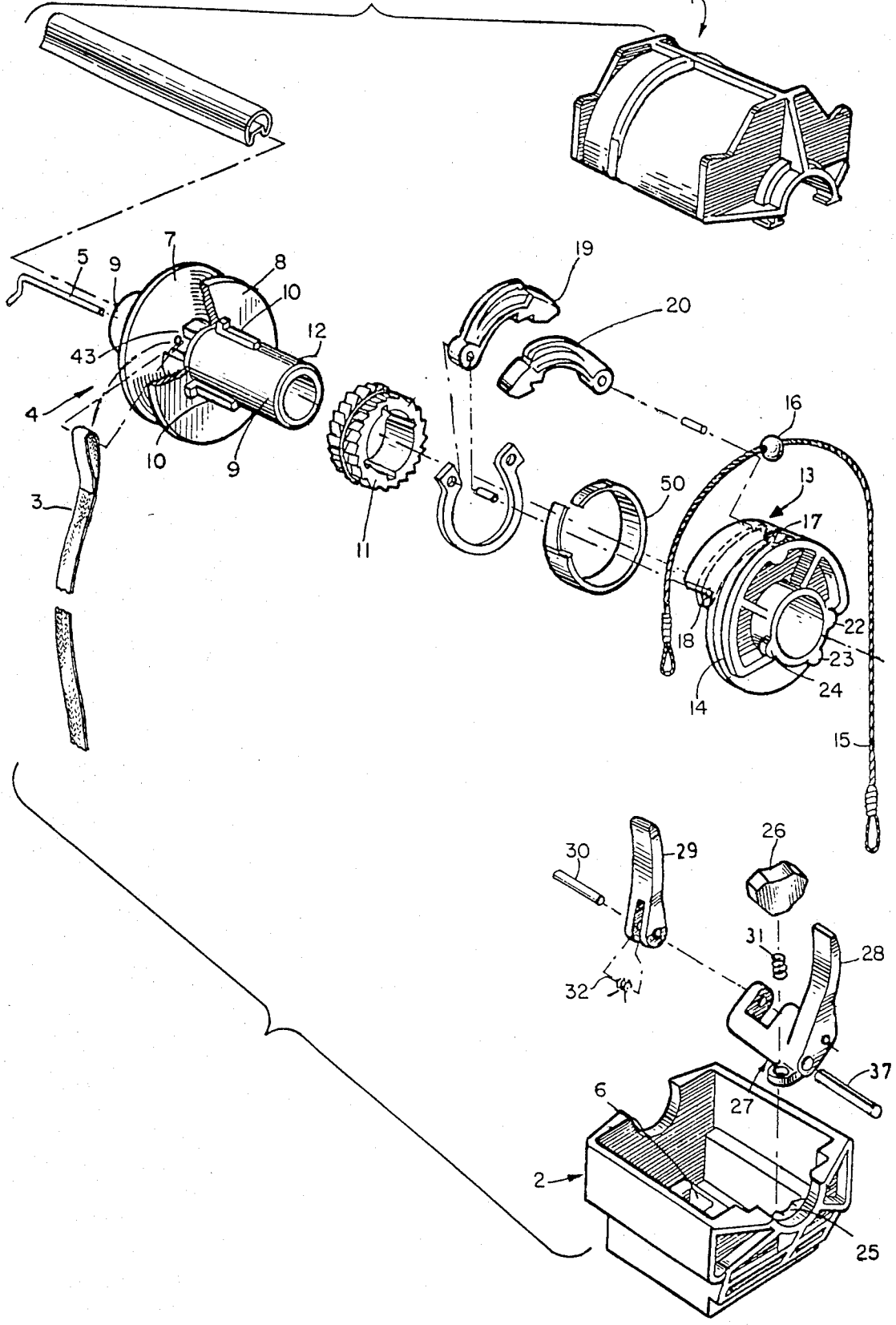
FIG. 1 is a perspective exploded view of a bearing bracket according to the invention.

The embodiment of a bearing bracket according to the invention as shown in FIG. 1 comprises an upper casing half 1 and a lower casing half 2 forming together a casing in which the mechanism is received and journalled for rotation.

A lifting tape 3 for lifting and lowering of the Venetian blind laths is at one end attached to a lifting roll 4 with the aid of a pin 5 and at the other end connected to the lowest blind lath, the tape 3 extending through a slot 6 in the bottom of the lower casing half 2. The tape 3 is coiled between two circular walls 7, 8 spaced from each other slightly more than the width of the tape 3, about a part of the tubular shaft 9 which is journalled in the casing halves 1, 2 and through which extends a drive shaft when the bearing bracket is mounted for use in an overhead structure.

The shaft 9 extends a short length from the one wall 7 which in turn in mounted position is situated adjacent the one end wall of casing 1, 2 and is journalled in this end wall. From wall 8 shaft 9 extends a considerable length and is provided, close to wall 8, with splines 10 adapted to engage a ratchet wheel 11 and, outside the splined range, with a bearing surface 12 for receiving a turning roll 13. The outermost end of shaft 9 is journalled in the opposite end wall of casing 1, 2.

In a groove 14 in the peripheral surface of turning roll 13 a turning cord or strap 15 is received. This strap 15 carries a ball 16 attached thereto which in the mounting position rests within a recess 17 in the groove 14, whereby strap 15 is caused to take part in the turning movements of turning roll 13. In a cavity 18 within the turning roll 13 a pair of pawls 19, 20 are received, said pawls being hingedly journalled on one shaft 21 each.

On the outwardly facing side of turning roll 13 three knobs 22, 23, 24 are provided which cooperate with a resilient bridge 25 in the lower casing half 2 to define the three positions of adjustment of the turning roll 13.

A stop block 26 is stationarily mounted in the bottom of lower casing half 2 and adapted to cooperate with pawls 19, 20 to release either of them during operation of the Venetian blind. This stop block 26 hereby defines the extreme positions of adjustment of the blind laths, i.e. the completely opened and completely closed positions.

A rocking stop 27 is journalled in the bottom of the lower casing half 2 and comprises, on the one hand, a stop arm which is adapted to swing around a shaft 37 in relation to the casing half 2 and which defines the intermediate position of adjustment of the blind laths by cooperation with the one pawl 19 and, on the other hand, a control arm 29 which by means of a shaft 30 is journalled for swinging movement in relation to the stop arm 28 and thereby also in relation to the casing half 2. A spring 31 urges stop arm 28 into abutment with stop block 26 and a spring 32 urges control arm 29 into abutment with the lifting roll 4.

A split sleeve 50 is intended to be arranged around the ratchet wheel 11 with a small bias so that it is possible for the sleeve 50 to be moved together with the ratchet wheel 11 a distance when rotating but not stronger than it allows the ratchet wheel 11 to rotate within the sleeve.

Figures 2, 3:
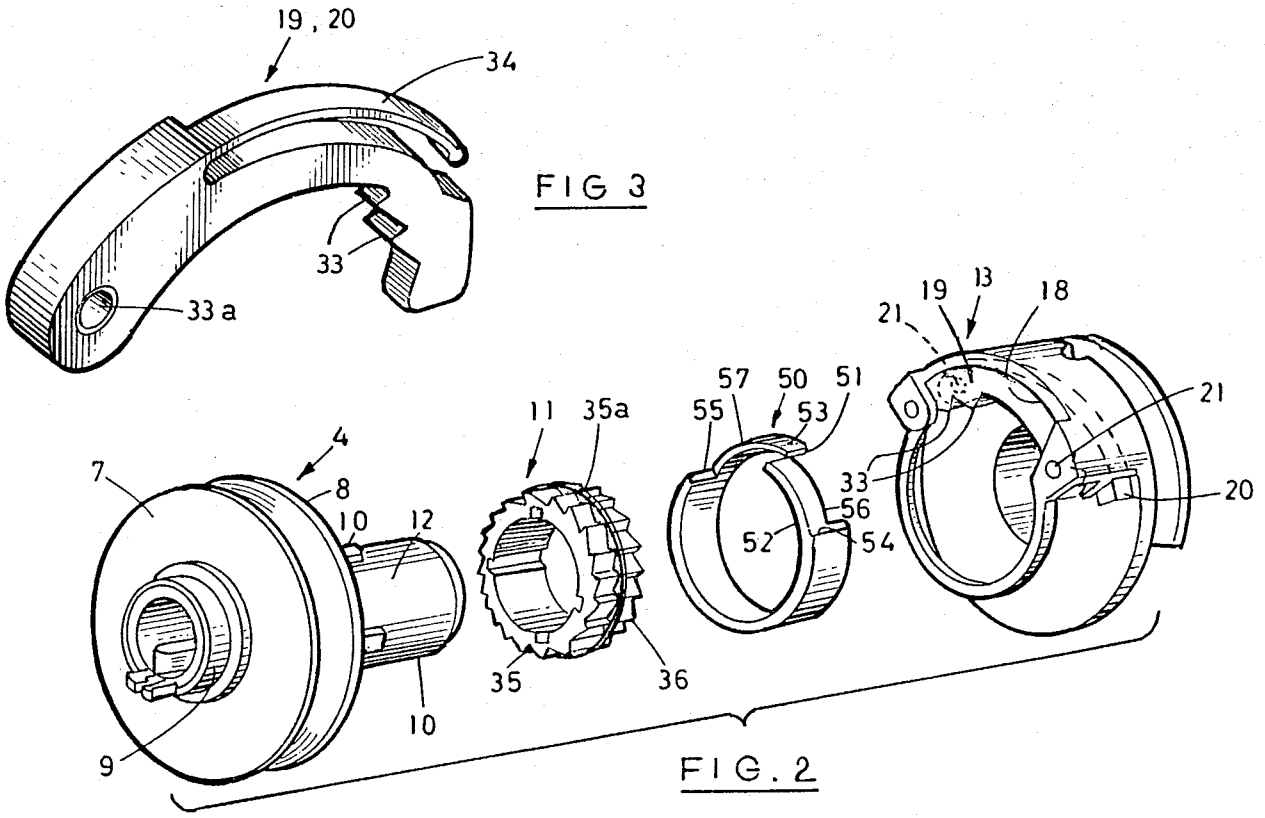
FIG. 2 is a perspective exploded view of the coupling mechanism.
FIG. 3 is a perspective view of a pawl included in the bearing bracket.

From FIG. 2 it appears more clearly how the lifting roll 4 and the turning roll 13 are coupled to each other, the pawl 19 being shown mounted in the turning roll 13. The pawl 19 has two latching teeth 33, which cooperate with the one set of ratchet teeth 35 on the ratchet wheel 11. The other set of ratchet teeth 36 on the ratchet wheel 11 which are directed opposed to the first set of ratchet teeth 35, cooperates with the latching teeth of the other pawl 20. The pawls 19, 20 are journalled above ratchet wheel 11, and their teeth are brought into engagement by the action of a spring 34 which means that when both pawls 19, 20 simultaneously are in engagement with teeth 35, 36, the coupling between the lifting roll 4 and the turning roll 13 is engaged. This in turn means that the Venetian blind is wind-secured so that the adjusted position is maintained in spite of the fact that the Venetian blind is subjected to baffling winds and similar weather forces.

The free ends of pawls 19, 20 extend out of the cavities 18 and may there be actuated for disengagement from the latching teeth 35, 36 of the ratchet wheel 11 which in the mounted position is disposed in the turning roll 13 below pawls 19, 20.

The sleeve 50 is split at 51 and it has in a free condition an internal diameter which is slightly smaller than the outer diameter of the ratchet wheel 11. The width thereof is substantially the same as the width of the ratchet wheel 11. In mounted position around the ratchet wheel 11 the sleeve 50 will be opened at the slit 51 and due to the resiliency of the sleeve 50 this will then with a slight bias rest against the ratchet wheel 11. In the transition between the two rows of ratchet teeth 35, 36 on the ratchet wheel 11 there is a circular ridge 35*a* the height of which is at least the same as the height of the tips of the ratchet teeth 35, 36. The sleeve 50 is primarily biased against said ridge 35*a*.

From the slit 51 and a distance along the sleeve 50 the thickness and the width thereof are less than for the rest of the sleeve 50 whereby two tongues 52, 53 are formed. Said tongues 52, 53 are only intended to keep the sleeve 50 on the ratchet wheel 11. At the base of said tongues 52, 53 which are of substantially the same width as half of the ratchet wheel 11 there is a shoulder 54, 55 the function of which will be described later on. At the side of each tongue 52, 53 there is an open portion 56, 57 of such an area that the teeth 33 of a pawl 19, 20 can therethrough reach and engage the teeth 35, 36 of the ratchet wheel 11.

In FIG. 3 there is shown a pawl 19, 20. This has a curve substantially corresponding to the outer shape of the ratchet wheel 11 and at one end there are the latching teeth 33 and at the other end thereof there is a through-bore 33*a* for the shaft 21. At the side of the pawl 19, 20 opposite to the side where the teeth 33 are, there is arranged the spring 34 biasing the pawl 19, 20 so that its teeth 33 are brought into safe engagement with the teeth 35, 36 of the ratchet wheel 11. In the shown embodiment this spring 34 is constituted by an arm manufactured integral with the pawl 19, 20 and extended in a slight curve from a place close to the shaft bore 33*a* and towards the other end of the pawl 19, 20 where the latching teeth 33 are.

In FIG. 4 there is shown the rocking stop 27 in assembled condition for mounting into the lower casing half 2. Through a hole 37*a* extends the shaft 37 attaching the stop 27 swingably to casing half 2, and spring 31 acts between a part of the bottom of casing half 2 and an arm 38 which extends from the stop 27 at the lower portion thereof in a direction opposite to that of stop arm 28 in relation to the hole 37*a* which means that the latter will be urged towards stop block 26. Control arm 29 which is journalled on shaft 30 is urged by spring 32 in the same direction as stop arm 28 but due to its position laterally thereof it will rest against the lifting roll 4, specifically against the portion thereof where the lifting tape 3 is coiled.

Figure 7:
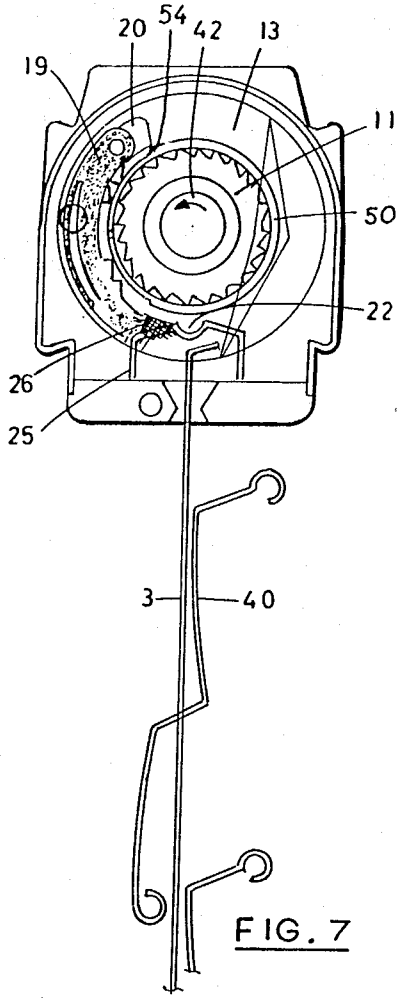
FIGS. 5 to 7 are schematic cross-sections of the bearing bracket according to the invention showing the three positions of adjustment thereof.

The way of operation of the embodiment of the bearing bracket according to the invention described by reference to FIGS. 1–4 will now be explained by reference to FIGS. 5–7. Only those parts are shown and described which are necessary to enable the reader to understand the way of operation.

Figure 5:
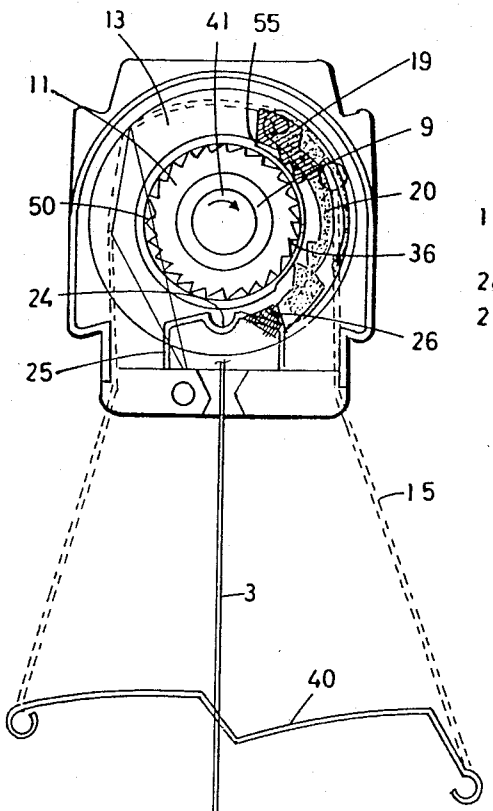

Fundamentally, FIG. 5 shows the Venetian blind during lifting. Shaft 9 is then rotating in the direction of arrow 41. During the first phase of this rotation the lifting roll 4 drives turning roll 13 to the position where pawl 20 abuts against stop block 26, causing the blind laths 40 to be adjusted to horizontal position as shown, and the turning roll 13 is maintained in this position due to the fact that knob 24 is retained by the resilient bridge 25. When the teeth 33 of the pawl 20 are disengaging the teeth 36 of the ratchet wheel 11, ratchet wheel 11 drives sleeve 50 a distance to the point where the shoulder 55 thereof abuts against the other pawl 19, which in this rotational movement is disengaged and lifts its teeth free from the teeth 35 whereby there is no ratching noise appearing. In the continued rotation of shaft 9 sleeve 50 is standing still and the ratchet wheel 11 is rotating within sleeve 50. The winding of the lifting tape 3 onto the lifting roll 4 can now take place without interference and without noise. The control arm 29 all the time rests against the lifting tape 3 without any actuation by the control arm 29.

Figure 6:
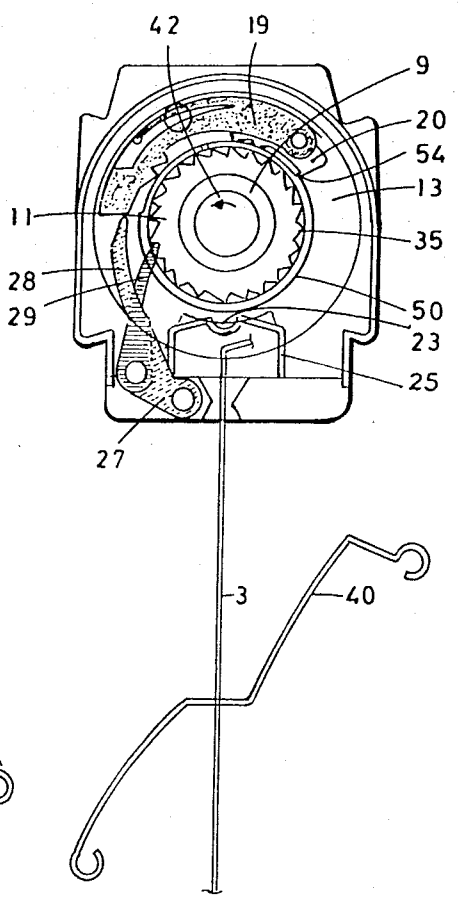

FIG. 6 shows the Venetian blind during lowering. Shaft 9 rotates in this case in the direction of arrow 42, i.e. in a direction opposite to the direction of lifting. During the first phase of this rotation the lifting roll 4 carries turning roll 13 to the position in which pawl 19 abuts against stop arm 28 causing the pawl to be disengaged from the teeth 35 on the ratchet wheel 11. In this position the blind laths 40 are adjusted to the intermediate position and the turning roll 13 is maintained in this position due to the fact that knob 23 is retained by the resilient bridge 25. When the teeth of the pawl 19 are disengaged from the teeth 35 on the ratchet wheel 11 the ratchet wheel 11 carries the sleeve 50 a distance until shoulder 54 abuts against the first pawl 20 which during this rotational movement is disengaged and lifts its teeth from teeth 36 whereby there is no ratching noise appearing. Sleeve 50 is during the continued rotation of shaft 9 standing still and the ratchet wheel 11 is rotating within sleeve 50. The unwounding of the lifting tape 3 from the roll 4 can take place without interference. Also during this rotation the control arm 29 is resting against the lifting tape 3 without any actuation by the control arm 29.

During continued rotation in the direction of arrow 42 and after complete lowering of the Venetian blind the lifting roll 4 is cleared of tape 3 causing shaft 9 to be exposed between walls 7 and 8. Control arm 29 is then resting directly against shaft 9 and will there enter into a cavity 43 shown in FIG. 1. During continued rotation control arm 29 is depressed and causes stop arm 28 to move outwardly out of engagement with pawl 19. Pawl 19 falls down towards the ratchet wheel 11 and engages ratchet teeth 35 to pull turning roll 13 to the position shown in FIG. 7 in which the blind laths 40 are in the vertical position and the blind thus is completely closed. In this position pawl 19 rests against the stop block 26 while pawl 20 is resting against the shoulder 54 of the sleeve 50 which shoulder 54 keeps the teeth of the pawl 20 out of engagement with the teeth 35. However, this position is the final position and continued rotation is meaningless because the Venetian blind in this case would be lifted with the laths in the closed position. Turning roll 13 is retained in this position due to the fact that knob 22 is retained by the resilient bridge 25.

Although, the purpose of the bearing bracket in accordance with the invention primarily is that the blind laths shall assume three predetermined positions, it is obviously possible to adjust them to other positions. However, such other positions can in this case not be considered as stable. It is also possible to make readjustments between the predetermined positions of adjustment without the necessity of lifting or lowering the Venetian blind for this purpose.

I claim:

1. Bearing bracket, mainly for outer-wall Venetian blinds and comprising a lifting roll (4), a turning roll (13) and a coupling (11, 19, 20), disengagably connecting said rolls (4, 13), the coupling comprising a ratchet wheel (11) having two rows of ratchet teeth (35, 36) and two pawls (19, 20) for cooperation with one row each of ratchet teeth (35, 36) on the ratchet wheel (11) and which during rotation of the lifting roll (4) carries the turning roll (13) to predetermined adjustment positions for the skewing of the blind laths (40) in which positions pawl (19, 20) is brought out of latching engagement with corresponding set of teeth (35, 36) on the ratchet wheel (11) to disengage the rolls (4, 13), and further comprising a sleeve (50) arranged around the ratchet wheel (11) within which sleeve (50) the ratchet wheel (11) is rotatable, sleeve 50 having opening (56, 57) through which the teeth (33) of the pawls (19, 20) are brought into engagement with the ratchet teeth (35, 36) on the ratchet wheel (11), sleeve (50) further including two abutments (54, 55) of which, during the rotation of the ratchet wheel (11) one or the other depending on the direction of rotation will be brought into contact with this engaged pawl (19, 20) and lifts this so that the teeth (33) thereof are free from the teeth (35, 36) on the ratchet wheel (11).

2. Bearing bracket as claimed in claim 1, wherein the ratchet wheel (11) includes a circular ridge (35*a*) between two rows of ratchet teeth (35, 36) the height of which being at least the height of the tips of the ratchet teeth (35, 36), and wherein said ridge (35*a*) with low friction carries the sleeve (50).

3. Bearing bracket as claimed in claim 1 wherein the sleeve (50) is split, and wherein the internal diameter thereof in free position is slightly less than the outer diameter of the ratchet wheel (11).

4. Bearing bracket as claimed in claim 2, wherein the sleeve (50) is split, and wherein the internal diameter thereof in free position is slightly less than the outer diameter of the ratchet wheel (11).

* * * * *